United States Patent [19]

Jacobson

[11] Patent Number: 4,928,581

[45] Date of Patent: May 29, 1990

[54] NEGATIVE AIR CONTROL UNIT AND CLOSURE STRUCTURE

[76] Inventor: Earl B. Jacobson, 510 S. Shore Dr., Crystal Lake, Ill. 60014

[21] Appl. No.: 277,772

[22] Filed: Nov. 30, 1988

[51] Int. Cl.[4] ..... F24F 7/00

[52] U.S. Cl. ..... 98/1.5; 4/527; 4/599; 98/33.1; 135/106; 135/117; 160/354

[58] Field of Search ..... 4/526, 527, 599, 612, 4/613; 98/1.5, 33.1, 42.02, 1; 135/95, 106, 117, 901, 902; 160/354, 371

[56] References Cited

U.S. PATENT DOCUMENTS

| | | | |
|---|---|---|---|
| 2,519,430 | 8/1950 | Brown | 4/599 X |
| 2,546,588 | 3/1951 | Ellis | 135/106 X |
| 3,169,543 | 2/1965 | McGerty | 135/106 X |
| 3,513,862 | 5/1970 | Pohl et al. | 135/117 |
| 3,629,875 | 12/1971 | Dow | 135/95 X |
| 3,766,844 | 10/1973 | Donnelly | 98/33.1 X |
| 4,084,597 | 4/1978 | Compton | 135/117 |
| 4,304,224 | 12/1981 | Forthey | 98/34.5 X |
| 4,570,384 | 2/1986 | Eckel | 160/354 X |
| 4,639,035 | 1/1987 | Icaacson | 160/354 X |
| 4,675,923 | 6/1987 | Ashley | 4/599 |
| 4,706,551 | 11/1987 | Schofield | 98/33.1 X |
| 4,800,597 | 1/1989 | Healey | 4/599 |

*Primary Examiner*—Harold Joyce

*Attorney, Agent, or Firm*—Leydig, Voit & Mayer

[57] ABSTRACT

A portable negative air control unit and closure structure which can be utilized therewith to form enumerable different configurations. The basic unit includes a base which can be a shower containment pool, at least one closure structure having a door therein and top and side fabric walls which are removably attached to the closure structure, such as by zippers. The unit also can be attached to additional walls to form one of several interconnected units.

11 Claims, 3 Drawing Sheets

FIG. 1
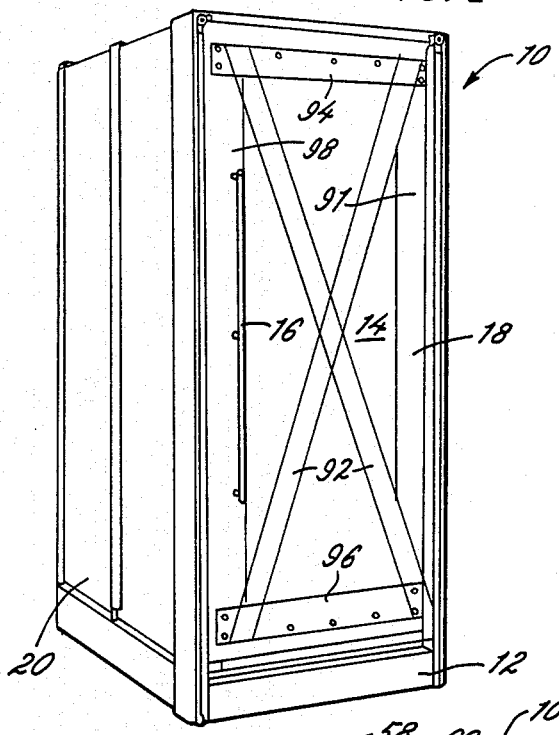
FIG. 2
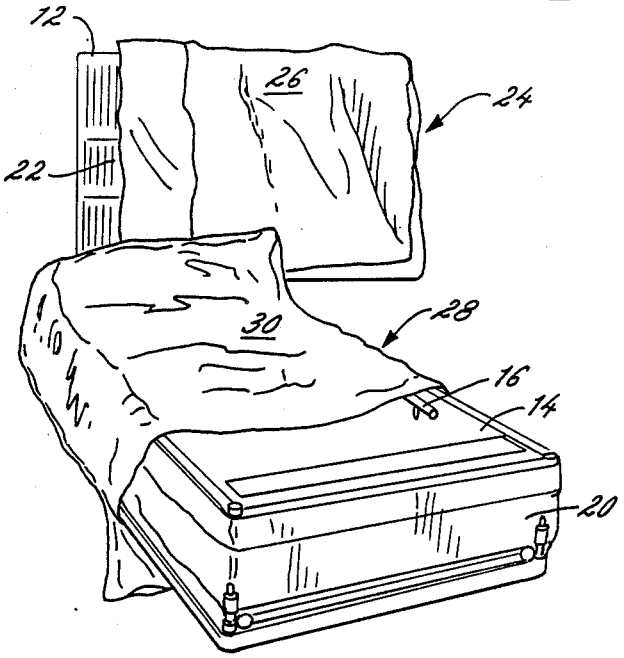
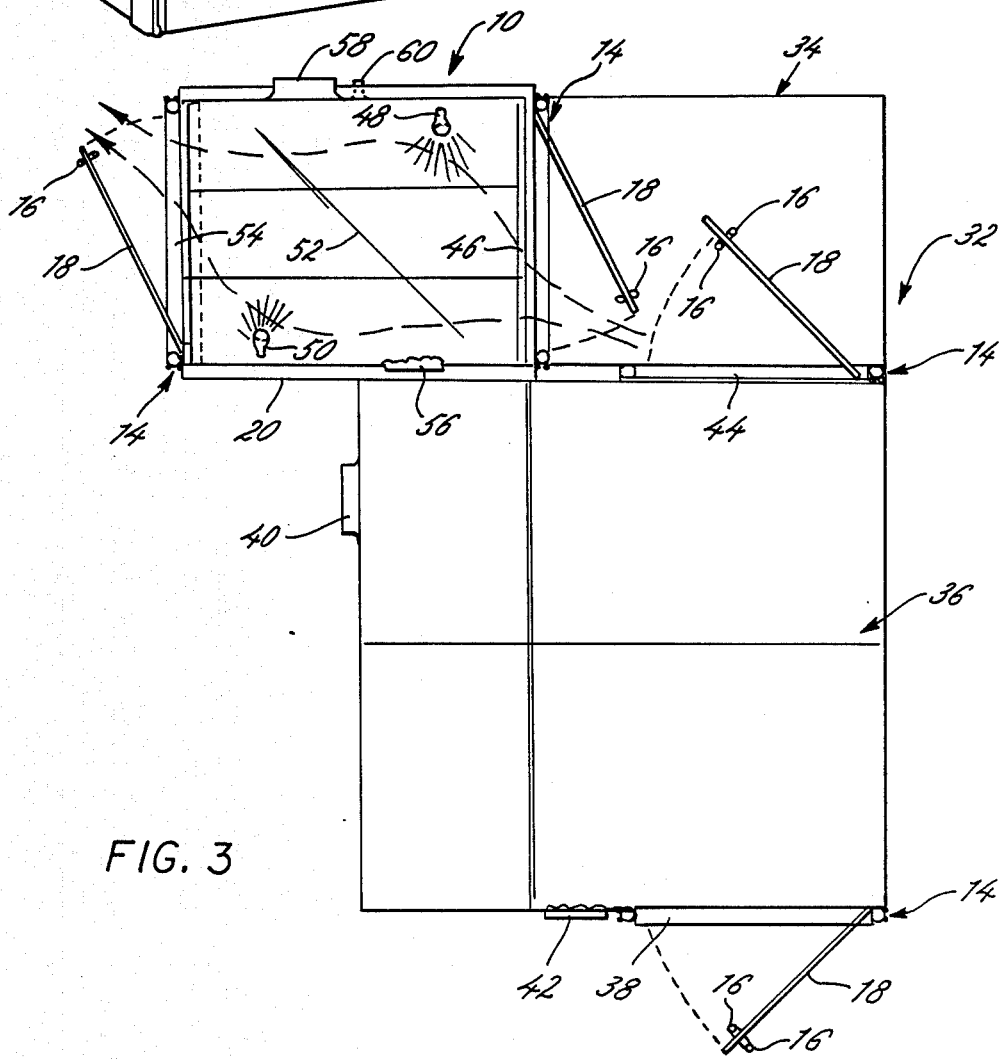
FIG. 3

FIG. 5
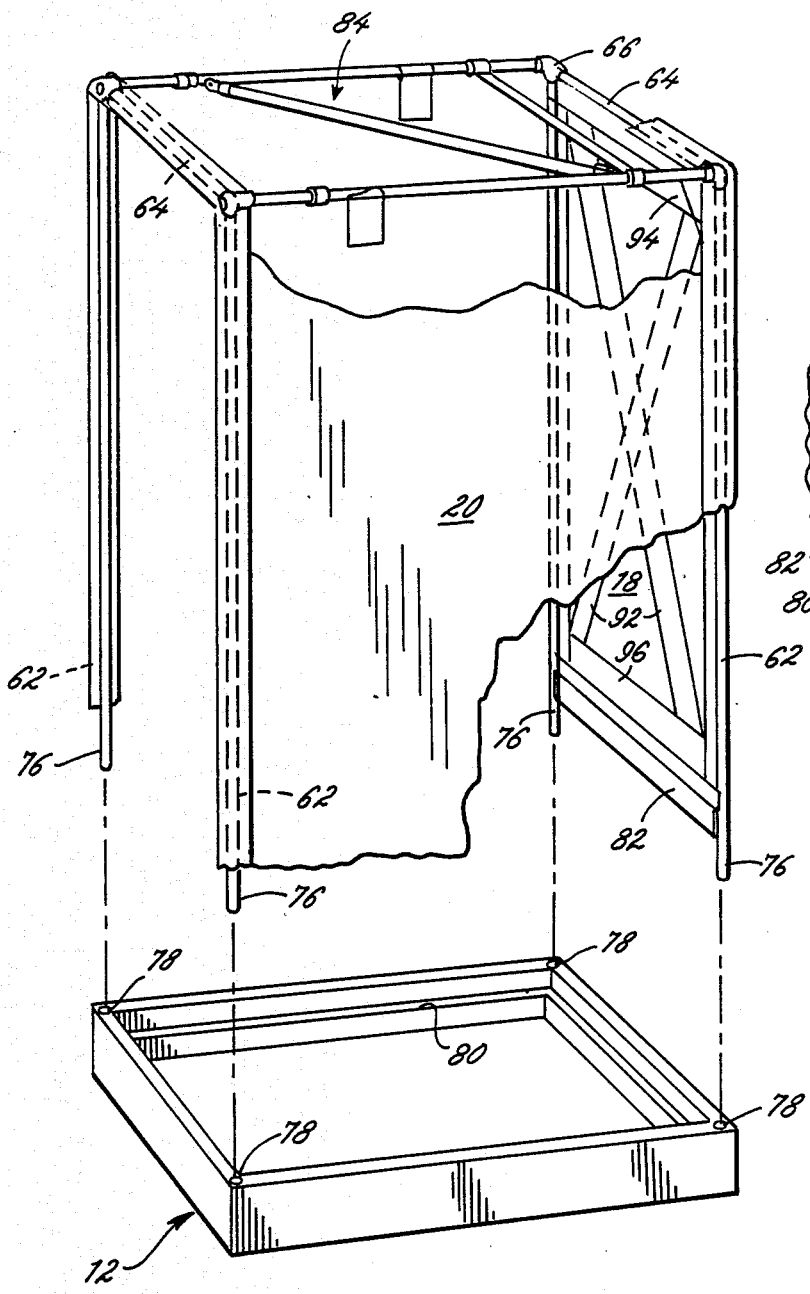
FIG. 6
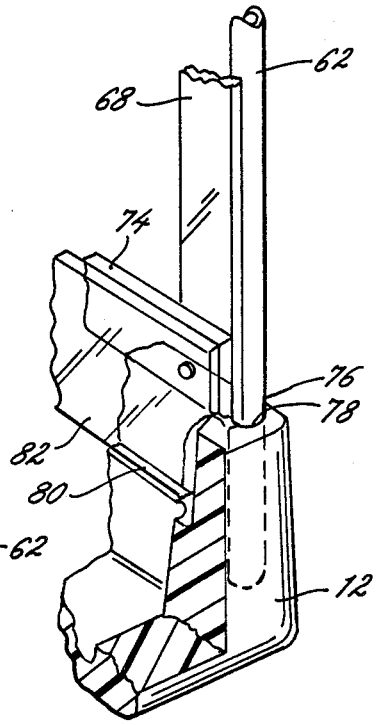
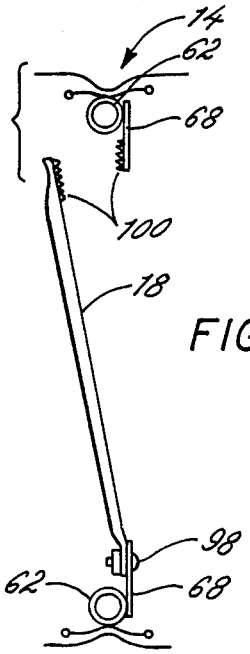
FIG. 7
FIG. 8
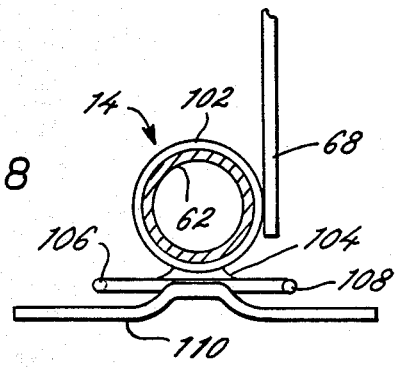

NEGATIVE AIR CONTROL UNIT AND CLOSURE STRUCTURE

BACKGROUND OF THE INVENTION

The application relates generally to hazardous waste removal systems and more particularly to a portable negative air control unit and closure structure utilized to control airborne particulate contamination.

The problems of asbestos fiber contamination and the removal of asbestos materials are well documented. Various types of containment structures have been utilized to control the airborne particulate matter such as asbestos fibers or other types of contaminants.

The prior structures generally are of two types. One time constructed, substantially permanent, type structures which generally are cumbersome and cannot be reutilized or portable structures which generally are not adapted to be utilized with negative air systems.

The prior portable structures generally are constructed from aluminum or rigid polyvinyl materials, which are not well suited for negative air utilization. Further, the closure structures of these portable structures, typically are formed by utilizing one or more flexible curtains. These curtains do not provide a suitable closure structure to maintain negative air control.

It therefore would be desirable to provide a portable negative air control unit, which is reusable and has a closure structure which maintains negative air control in the unit.

SUMMARY OF THE INVENTION

The above and other disadvantages of prior art negative air control systems and techniques are overcome in accordance with the present invention by providing a portable negative air control unit having an improved closure structure.

The unit and closure structure are modular and can be configured into a substantially infinite variety of configurations. One basic unit, which can be utilized as a shower, includes a containment pool base, one or a pair of closure structures including a door forming opposite walls of the unit mountable into the pool base and a top and connecting side walls formed of reinforced fabric. The top and side walls preferably are attached to the closure structures by zippers to complete the unit.

BRIEF DESCRIPTION OF THE DRAWINGS

FIG. 1 is a perspective view of an assembled negative air control unit of the invention;

FIG. 2 is a perspective view of the unit of FIG. 1 disassembled;

FIG. 3 is a top plan view of another embodiment illustrating the utilization of the air control unit and improved closure structures of the invention;

FIGS. 4 and 5 are partial perspective views of portions of the unit of FIG. 1;

FIG. 6 is a partial perspective view illustrating the mounting of the unit elements;

FIG. 7 is a top plan view of the improved closure structure of the invention; and FIG. 8 is an enlarged partial plan view of the structure of FIG. 7.

DESCRIPTION OF THE PREFERRED EMBODIMENTS

Figure 4:
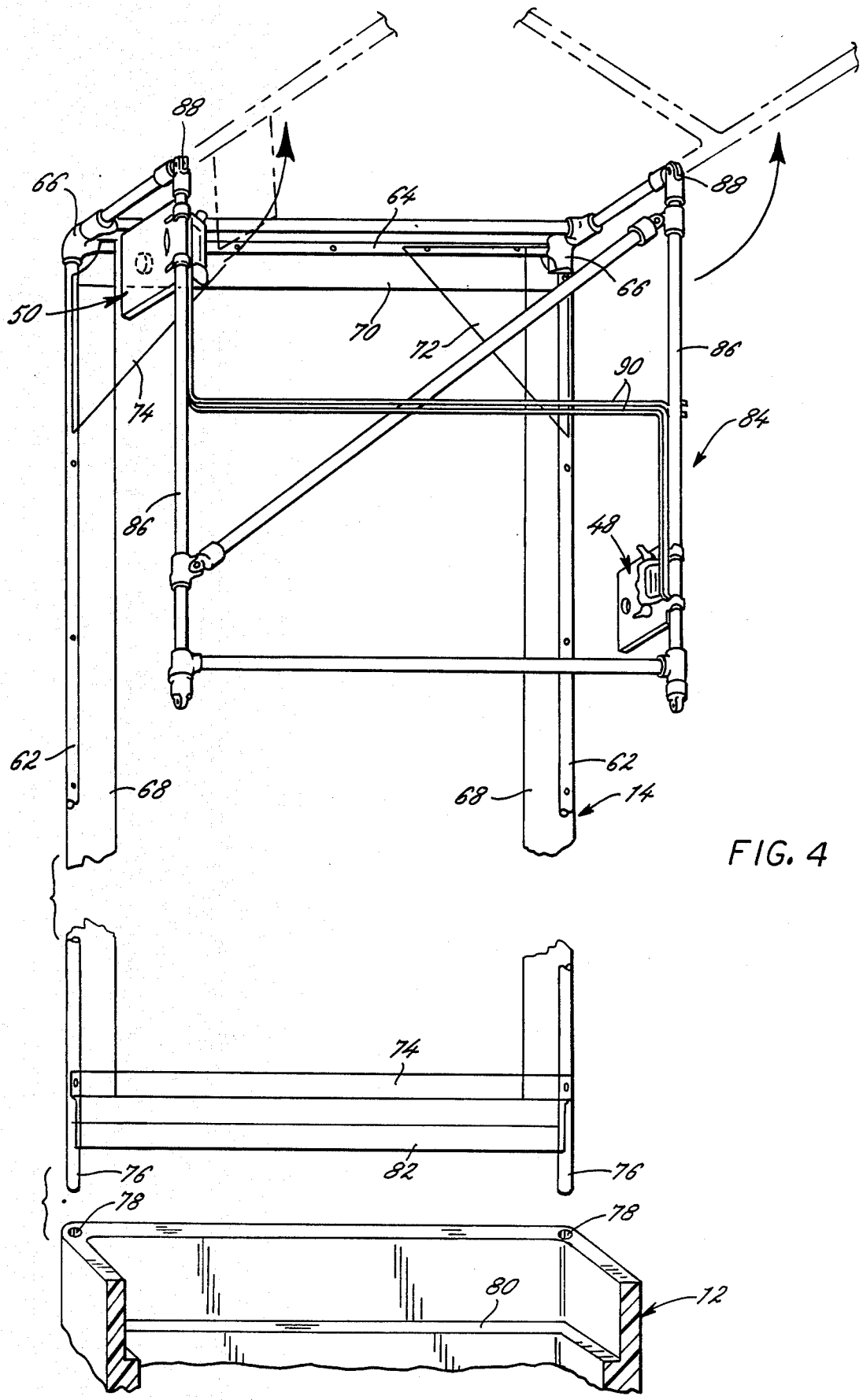

Referring to FIG. 1, a first embodiment of the assembled negative air control unit of the invention is designated generally by the reference character 10. The unit 10 includes a base 12 which forms a containment pool when the unit 10 is utilized as a shower. The unit 10 includes at least one closure structure 14, which includes at least one handle 16 mounted to a hingedly mounted door panel 18. The hinged door panel 18 provides a number of advantages over the curtain of the prior art.

As will be described in detail hereinafter, the closure structure 14 mounts into the base 12 and includes a zipper around the periphery thereof to which connecting top and side walls, one of which is 20 is illustrated, are attached. The walls preferably are flexible and formed from vinyl or polyester coated rubber material, such a nylon reinforced tear resistant vinyl coated fabric. The fabric can be a loose weave polyester material, such as scrim. The base 12 preferably can be formed from fiberglass, but could be formed from other materials as desired.

The unit 10 is portable and can be collapsed for transportation and storage, as illustrated in FIG. 2. The base 12 will include a grating 22 when utilized as a shower/-water containment pool and forms one storage unit 24, which can be covered by a carrier pouch 26, which also can be formed from nylon reinforced vinyl material. The closure structure 14 and the walls 20 can be folded into a second compact storage unit 28, which also can be covered by a carrier pouch 30. The unit 28 also can be placed on edge and a carrier pouch (not illustrated) can be dropped over it, to avoid as much handling as possible.

The unit 10 can be assembled into any number of different configurations, for different uses, one of which is illustrated in FIG. 3. The unit 10 forms part of a three room module 32 which includes an optional air lock room 34 and a change room 36. Each of the rooms 34 and 36 will be formed similar to the unit 10 and will include the closure structures 14 as needed to provide the door panels 18 for entry and exit of the work site. The rooms 34 and 36 will not need containment pools and will only include removable floor panels as a base for the worker to walk on.

The change room 36 includes an outer doorway 38 which forms the exit and entrance to the module 32 from outside the work site. The negative air pressure ensures the sealing of the door 18, when it is closed in the doorway 38. The room 36 includes an outlet attachment 40, which is connected to a negative air machine or source to provide the negative air pressure in the room 36. This prevents contamination from exiting the room 36 through the outside doorway 38. The room 36 includes a make up air filter 42 which filters incoming air and is adjustable to maintain the desired negative air pressure in the room 36.

A connecting doorway 44 joins the change room 36 to the air lock 34. The air lock 34 operates in a conventional manner. The doorway 44 is normally closed, as is a second connecting doorway 46 which connects the air lock 34 to the shower unit 10. The worker opens the doorway 44 and enters the air lock 34 from the room 36. The doorway 44 then is closed, the negative air pressure aiding in sealing the door 18 shut. THe worker then opens the doorway 46 and enters the shower unit 10. The air lock 34 also can include a filter like the filter 42 (not illustrated).

The shower unit 10 is illustrated with a pair of shower heads 48 and 50 and can include a divider curtain 52, so that two workers can shower at the same time. Normally the worker would not shower entering the work site (not illustrated) and would just pass through the shower through another doorway 54. The unit 10 also includes a make up air filter 56, which is utilized in the same manner as the filter 42. A source of negative air is attached to an outlet 58 to maintain the negative air pressure in the unit 10 to avoid contamination leakage.

The workers typically will shower when returning to the module 32 from the work site. The contaminated water retained in the base 12 of the unit 10, can be drained through an external drain connection 60 formed in the base 12.

Referring now to FIGS. 4–6, the assembly of the collapsible unit 10 is best illustrated. The closure structure 14 includes a pair of upstanding frame pipes or poles 62 forming the sides of the structure 14. A cross pipe 64 is mounted across the top ends of the pipes 62 by a pair of tee-type brackets 66. The pipes 62 and 64 are fabric covered (best illustrated in FIG. 8) and have polymer frame pieces, such as formed from a plastic-like material such as lexan, attached thereto by rivets or screws to complete the frame for the door 18. The particular number and size of the frame pieces is not critical and can be selected as desired to form a rigid, but lightweight door frame.

In the embodiment illustrated, the structure 14 includes a pair of rectangular frame pieces 68 attached to the pipes 62. The top pipe 64 includes a similar piece 70 secured thereto. For rigidity of the structure 14, a pair of corner pieces 72 each are attached to one of the pipes 62 and to the cross pipe 64 and the respective frame pieces 68 and 70. The bottom of the frame includes at least one crosspiece 74 which is attached to both the pipes 62 and both the pieces 68.

The bottom ends 76 of the pipes 62 preferably are left bare and are mountable into the base 12 into bores 78. The structure 14 then forms one side wall frame piece for the unit 10 or the other types of rooms 34 and 36. When the base 12 forms part of the shower unit 10, an internal ledge 80 is provided for the grating 27. Also, the bottom of the structure 14 preferably will include a splash guard 82 (best illustrated in FIG. 6) which is attached to the bottoms of the pipes 62 and can be attached to the crosspiece 74. The guard 82 is shaped to fit over and into the base 12 above the grate ledge 80. A curtain (not illustrated) also can be hung inside the structure 14 to further assist in preventing water from being splashed out of the unit 10.

Typically, although not illustrated in FIG. 5, the unit 10 or the rooms 34 and 36 will include a second closure structure 14 mounted into an adjacent wall of the base 12 (see room 34 in FIG. 3) or in the opposite wall of the base 12 (see unit 10 in FIG. 3). Once the other closure structure 14 or additional frame pipes 62 are inserted into the base 12, the rest of the frame and walls are added thereto.

In the shower embodiment, the unit 10 includes a foldable shower assembly 84. The assembly 84 includes one or more of the shower heads 48 and 50 mounted onto foldable cross pipes 86. The cross pipes 86 are foldable or hinged by socket swivels 88 to allow the assembly 84, illustrated in FIG. 4, to fold for storage as depicted in FIG. 2. The assembly 84 is erected by unfolding the pipes 86 and attaching them to the opposite wall or frame structure 14. The shower heads typically are connected to hot and cold water pipes 90 also mounted on the assembly 84, which are connected to a suitable source at the work site (not illustrated).

Once the side and top frame is assembled, as illustrated in FIG. 5, with the pipe ends 76 inserted into the base 12, then the walls 20 are attached thereto. This completes the assembly of the unit 10. The door panel 18 has not been described in detail and can be formed in any number of embodiments, as long as the unit 10 is substantially sealed to form the negative air structure. Although not illustrated, the door 18 also can include an adjustable flap which is partially opened or closed to provide the desired negative air control.

For example, one embodiment of the door panel 18 is illustrated in FIGS. 1, 5 and 7. The door 18 includes one or more handles 16 as previously described. The door 18 which has an outer fabric covering to sealingly cover the doorway, includes internal frame pieces to form the fabric support. The door 18 preferably includes a pair of cross bars 92, joined by a top and bottom kick plate 94 and 96, respectively. The door 18 also includes one or a pair of upright supports 98 affixed to the cross bars 92 and the kick plates 94 and 96. Preferably the material of the door 18 is sealed around the frame pieces, like an envelope. The door material extends beyond the frame pieces on the sides, top and bottom of the door 18 to provide a very positive seal against the door frame of the structure 14.

The mounting and sealing construction of the door 18 is best illustrated in FIG. 7. The closure structure 14, including the support pipes 62 and the frame pieces 68, have previously been described. The structure 14 is mounted such that the door 18 is opened against the negative air pressure, which ensures that the door 18 normally remains closed and sealed when the negative air is operative to prevent leakage. The door 18 is mounted along one edge to one of the frame pieces 68 by a plurality of fasteners 98. The fabric material of the door has sufficient flexibility to itself form the door hinge. To assist in maintaining the negative air closure, the door 18 preferably includes some type of additional seal, such as a magnetic strip mounted on the door and the other frame piece 68 (not illustrated) or a conventional loop and hook structure 100, as illustrated.

Referring to FIG. 8, the structure to enable the closure 14 to be secured to one or more rooms or units is best illustrated. The pipe 62 includes a fabric covering 102. The frame piece 68 is riveted or otherwise secured to the pipe 62 through the fabric 102 to provide an air flow seal between the pipe 62 and the frame piece 68. The fabric covering 102 also has sealingly attached a two-sided zipper assembly 104. The assembly 104 includes a pair of zipper structures 106 and 108, which mate with a zipper structure on the edge of the wall 20 (not illustrated). The zipper assembly 104 also includes an outer fabric flap 110 which seals either one or both zipper structures 106 and 108 from air flow leakage.

Many modifications and variations of the present invention are possible in light of the above teachings. The structures can be formed in numerous sizes, shapes and configurations and the materials utilized can be varied as desired. It is, therefore, to be understood that within the scope of the appended claims, the invention may be practiced otherwise than as specifically described.

What is claimed and desired to be secured by Letters Patent of the United States is:

1. A door closure structure for utilization in negative air control modules having walls and a base, said structure comprising:

a structure door frame having an inner peripheral edge and an outer periphery including at least one wall attaching means sealingly secured thereto around said periphery, said attaching means are zipper means and include an outer sealing flap over said zipper means;

a door panel mounted to said frame, including a rectangular frame having an outer peripheral edge and a fabric covering sealingly secured to said rectangular frame and extending beyond said inner peripheral edge, to seal against said structure door frame; and said door frame including means for mounting said structure door frame into the base.

2. The closure structure as defined in claim 1 wherein said mounting means include a pair of pipes adapted to mount at one end thereof into bores in said base.

3. The closure structure as defined in claim 1 wherein said door panel outer peripheral edge is sized smaller than said door frame inner peripheral edge.

4. The closure structure as defined in claim 1 wherein said zipper means includes a pair of zipper structures forming a two sided zipper assembly, both covered by said outer sealing flap to prevent air flow therethrough.

5. The closure structure as defined in claim 1 wherein said door frame includes a splash plate which extends into said base when said door frame is mounted into the base.

6. A portable and collapsible negative air control unit comprising:

a base;

at least one closure structure, said structure including a structure door frame having an inner peripheral edge and an outer periphery including at least one wall attaching means sealingly secured thereto around said periphery, said closure structure attaching means are zipper means and include an outer sealing flap over said zipper means, said door frame including means for mounting said structure door frame into said base;

a door panel mounted to said frame, including a rectangular frame having an outer peripheral edge and a fabric covering sealingly secured to said rectangular frame and extending beyond said inner peripheral edge, to seal against said structure door frame; and a unit wall secured to said closure structure.

7. The unit as defined in claim 8 wherein said closure structure mounting means include a pair of pipes adapted to mount at one end thereof into bores in said base.

8. The unit as defined in claim 6 wherein said closure structure door outer peripheral edge is sized smaller than said door frame inner peripheral edge.

9. The unit as defined in claim 6 wherein said closure structure zipper means include a pair of zipper structures, forming a two sides zipper assembly both covered by said outer sealing flap to prevent air flow therethrough.

10. The unit as defined in claim 6 wherein said closure structure door frame includes a splash plate which extends into said base when said door frame is mounted into said base.

11. The unit as defined in claim 6 including at least a pair of closure structures.

* * * * *